US008983100B2

(12) United States Patent
Tinaphong

(10) Patent No.: US 8,983,100 B2
(45) Date of Patent: Mar. 17, 2015

(54) PERSONAL SOUND AMPLIFIER

(71) Applicant: VOXX International Corporation, Hauppauge, NY (US)

(72) Inventor: Prapan Paul Tinaphong, Carmel, IN (US)

(73) Assignee: VOXX International Corporation, Hauppauge, NY (US)

( * ) Notice: Subject to any disclaimer, the term of this patent is extended or adjusted under 35 U.S.C. 154(b) by 40 days.

(21) Appl. No.: 13/736,771

(22) Filed: Jan. 8, 2013

(65) Prior Publication Data

US 2013/0188812 A1 Jul. 25, 2013

Related U.S. Application Data

(60) Provisional application No. 61/584,402, filed on Jan. 9, 2012.

(51) Int. Cl.
*H04R 25/00* (2006.01)

(52) U.S. Cl.
CPC ..... *H04R 25/554* (2013.01)
USPC ..... 381/315; 381/312

(58) Field of Classification Search
CPC .... H04R 25/43; H04R 25/554; H04R 25/604; H04R 2225/55
USPC ..... 381/312, 315
See application file for complete search history.

(56) References Cited

U.S. PATENT DOCUMENTS

| | | | | |
|---|---|---|---|---|
| 6,874,037 | B1 | 3/2005 | Abram et al. | 709/248 |
| 6,965,816 | B2 | 11/2005 | Walker | 701/16 |
| 7,206,429 | B1 | 4/2007 | Vossler | 381/381 |

(Continued)

FOREIGN PATENT DOCUMENTS

WO WO 02/12024 2/2002

OTHER PUBLICATIONS

The International Preliminary Report on Patentability dated Jul. 15, 2014, the International Search Report dated Mar. 19, 2013 and the Written Opinion of the International Searching Authority dated Mar. 19, 2013, issued by the International Bureau of WIPO for Applicant's corresponding PCT Application No. PCT/US2013/020692, filed on Jan. 8, 2013.

*Primary Examiner* — Curtis Kuntz
*Assistant Examiner* — Ryan Robinson
(74) *Attorney, Agent, or Firm* — Gerald T. Bodner

(57) ABSTRACT

A personal sound amplifier device in the form of a hearing aid worn by a user not only amplifies sounds but also communicates wirelessly with an external electronic device, such as a cellular telephone. The personal sound amplifier device includes a first microphone, an amplification circuit electrically connected to the first microphone, and a speaker electrically connected to the amplification circuit for amplifying ambient sound detected by the first microphone. A second microphone is situated away from the first microphone. A radio frequency (RF) transmitter and receiver circuit is electrically connected to the second microphone and to the speaker. An antenna is connected to the RF transmitter and receiver circuit. The user's voice is detected by the second microphone and transmitted by the RF transmitter and receiver circuit, through the antenna, to an external electronic device. Signals from the external electronic device are received by the antenna and processed by the RF transmitter and receiver circuit, and are emitted as sound through the speaker for the user to hear.

7 Claims, 6 Drawing Sheets

(56) References Cited

U.S. PATENT DOCUMENTS

| | | | | |
|---|---|---|---|---|
| 7,254,246 | B2 | 8/2007 | Jakob | 381/315 |
| 7,349,782 | B2 | 3/2008 | Churchill et al. | 701/45 |
| 7,395,214 | B2 | 7/2008 | Shillingburg | 705/2 |
| 7,450,731 | B2 * | 11/2008 | Barthel | 381/313 |
| 7,590,530 | B2 | 9/2009 | Zhao et al. | 704/226 |
| 7,593,537 | B2 * | 9/2009 | Enzmann | 381/315 |
| 7,602,928 | B2 * | 10/2009 | Moo et al. | 381/315 |
| 7,639,831 | B2 | 12/2009 | Hagberg | 381/380 |
| 7,715,577 | B2 | 5/2010 | Allen et al. | 381/312 |
| 7,774,052 | B2 | 8/2010 | Burton et al. | 600/544 |
| 7,778,434 | B2 | 8/2010 | Juneau et al. | 381/328 |
| 7,830,897 | B1 | 11/2010 | Tannenbaum | 370/401 |
| 7,831,055 | B2 | 11/2010 | Frerking et al. | 381/312 |
| 7,903,827 | B1 | 3/2011 | Lockwood et al. | 381/60 |
| 7,957,768 | B2 | 6/2011 | Smith et al. | 455/566 |
| 7,978,091 | B2 | 7/2011 | Boillot | 340/686.1 |
| 8,027,638 | B2 * | 9/2011 | Sanguino et al. | 455/41.2 |
| 8,035,255 | B2 | 10/2011 | Kurs et al. | 307/104 |
| 2001/0008839 | A1 | 7/2001 | Cho | 455/550 |
| 2008/0165994 | A1 * | 7/2008 | Caren et al. | 381/312 |
| 2008/0269926 | A1 | 10/2008 | Xiang et al. | 700/94 |
| 2010/0310084 | A1 | 12/2010 | Hersbach | 381/71.6 |
| 2011/0136537 | A1 * | 6/2011 | Marterer | 455/556.1 |
| 2011/0255723 | A1 | 10/2011 | Obradovic et al. | 381/328 |

* cited by examiner

PERSONAL SOUND AMPLIFIER

CROSS-REFERENCE TO RELATED APPLICATIONS

This application is related to U.S. Provisional Application Ser. No. 61/584,402, filed on Jan. 9, 2012, and entitled "Personal Sound Amplifier", the disclosure of which is incorporated herein by reference and on which priority is hereby claimed.

BACKGROUND OF THE INVENTION

1. Field of the Invention

The present invention relates to personal sound amplification devices for use by hearing impaired persons, and more particularly relates to personal sound amplification devices having Bluetooth™ functionality.

2. Description of the Prior Art

Conventional personal sound amplifiers ("PSAs"), including hearing aids, do not have integrated Bluetooth™ radios. The integration of Bluetooth™ radios into PSAs has been problematic due to battery power consumption, output sound interference, and the space required to incorporate a Bluetooth™ circuit within a hearing aid housing also having the PSA circuit. To utilize Bluetooth™ technology, conventional PSA designs resort to utilizing a pendant unit worn by the user as a frequency convertor between the PSA device and Bluetooth™ quipped electronic devices, such as smart phones, the Apple iPad™/iPhone™ devices, and Blackberry™ devices. The pendant unit converts the 2.4 GHz Bluetooth™ frequency into lower frequencies to avoid interference with the integrated circuitry within the PSA (hearing aid), and consumes less battery power. This pendant unit provides the additional internal space needed for housing a relatively large battery to power the frequency convertor circuitry, and a relatively large antenna. However, to utilize the Bluetooth™ capabilities, consumers must inconveniently wear the pendant unit along with the PSA. Conventional pendant units have significantly limited transmission ranges and signal loss problems. Accordingly, the user must wear this separate pendant unit having a larger battery and a larger antenna.

OBJECTS AND SUMMARY OF THE INVENTION

It is an object of the present invention to provide a personal sound amplifier having an integrated Bluetooth™ circuit.

It is another object of the present invention to provide a personal sound amplifier in the form of a hearing aid which includes a hearing aid amplification circuit and a short range radio frequency (RF) transmitter and receiver circuit to allow wireless communications between the hearing aid and an external electronic device, such as a cellular telephone.

It is still another object of the present invention to provide a personal sound amplifier device, in the form of a hearing aid, which includes an amplifier circuit for amplifying ambient noise, and a wireless communication circuit for wirelessly communicating with an external electronic device, such as a cellular telephone, and which allows the user of the personal sound amplifier device to selectively permit operation of just the amplifier circuit, or allow operation of both the amplifier circuit and the wireless communication circuit.

It a further object of the present invention to provide a personal sound amplifier which is small in size and convenient to use and which includes the capability of wirelessly communicating with a remote, external electronic device.

It is yet a further object of the present invention to provide a hearing aid having Bluetooth™ functionality and which requires no separate pendant unit to effect wireless communication with an external, remote electronic device, such as a cellular telephone.

It is another object of the present invention to provide a personal sound amplifier which overcomes the inherent disadvantages of conventional personal sound amplifiers.

The present invention provides a novel PSA that includes an embedded low power Bluetooth™ radio that overcomes the disadvantages found in conventional PSA designs. In accordance with one form of the present invention, a personal sound amplifier is preferably formed in the shape of, and functions as, a hearing aid worn by a user on or in his ear. The personal sound amplifier includes an ambient sound amplification circuit, a first microphone electrically connected to the ambient sound amplification circuit, and a speaker or transducer. The first microphone detects ambient sounds, and provides an output signal corresponding to the ambient sounds detected by the first microphone to the ambient sound amplification circuit. The ambient sound amplification circuit effectively amplifies the sounds detected by the first microphone, and provides an output signal corresponding to the amplified ambient sounds to the speaker or transducer, which amplified sounds may be heard by the user of the personal sound amplifier.

The personal sound amplifier also includes a short range, radio frequency (RF) transmitter and receiver circuit, such as a Bluetooth™ circuit, to allow wireless communications between the personal sound amplifier and an external electronic device, such as a cellular telephone. The RF transmitter and receiver circuit is electrically connected to a second microphone and to the speaker or transducer of the sound amplification circuit. The second microphone detects sounds when the user speaks, and provides an output signal corresponding thereto to the RF transmitter and receiver circuit. The RF transmitter and receiver circuit transmits a corresponding signal wirelessly to an external electronic device situated remotely from the personal sound amplifier. An antenna connected to the output of the RF transmitter and receiver circuit is used to transmit signals from the personal sound amplifier to the external electronic device, and to receive signals transmitted by the external electronic device to the personal sound amplifier.

More specifically, the signals which are transmitted by the external electronic device are received by the antenna of the personal sound amplifier. The antenna provides such received signals to the RF transmitter and receiver circuit, which converts such signals to audible frequency signals and amplifies the audible frequency signals (or uses the amplification circuit for amplifying these signals), and provides the amplified audible frequency signals to the speaker or transducer of the personal sound amplifier.

The user of the personal sound amplifier may communicate wirelessly with an external electronic device, such as a cellular telephone, situated remotely from the personal sound amplifier, as well as selectively hearing amplified ambient sounds. The user may disable the RF transmitter and receiver circuit so that only the amplification circuit for amplifying ambient sounds is operational, or the user may enable both the ambient sound amplification circuit and the RF transmitter and receiver circuit so that he may both hear ambient sounds, amplified, and wirelessly communicate with an external electronic device, such as a cellular telephone.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
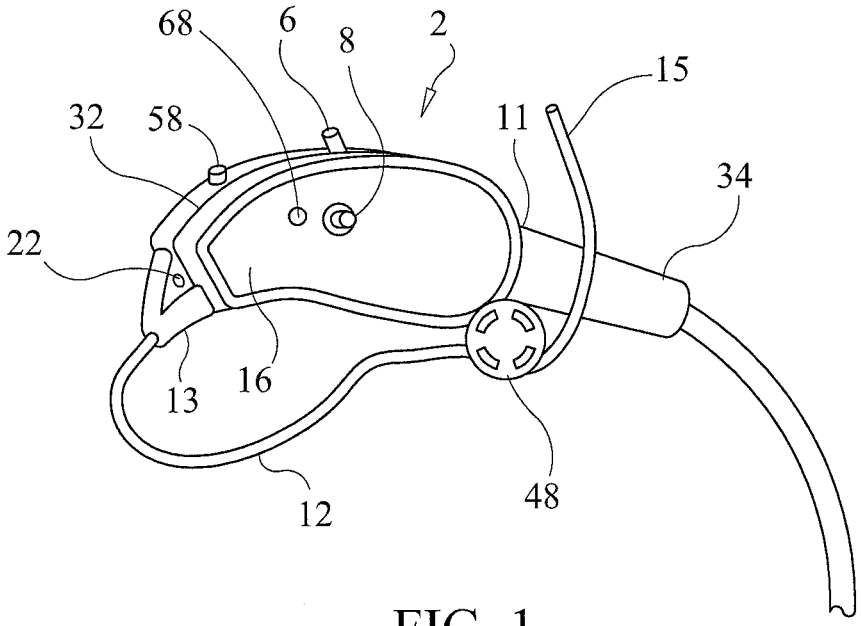
FIG. 1 is a perspective view of a personal sound amplifier formed in accordance with the present invention showing a charging cable connected to the personal sound amplifier, the personal sound amplifier being in the form of a hearing aid.
Figure 3A:
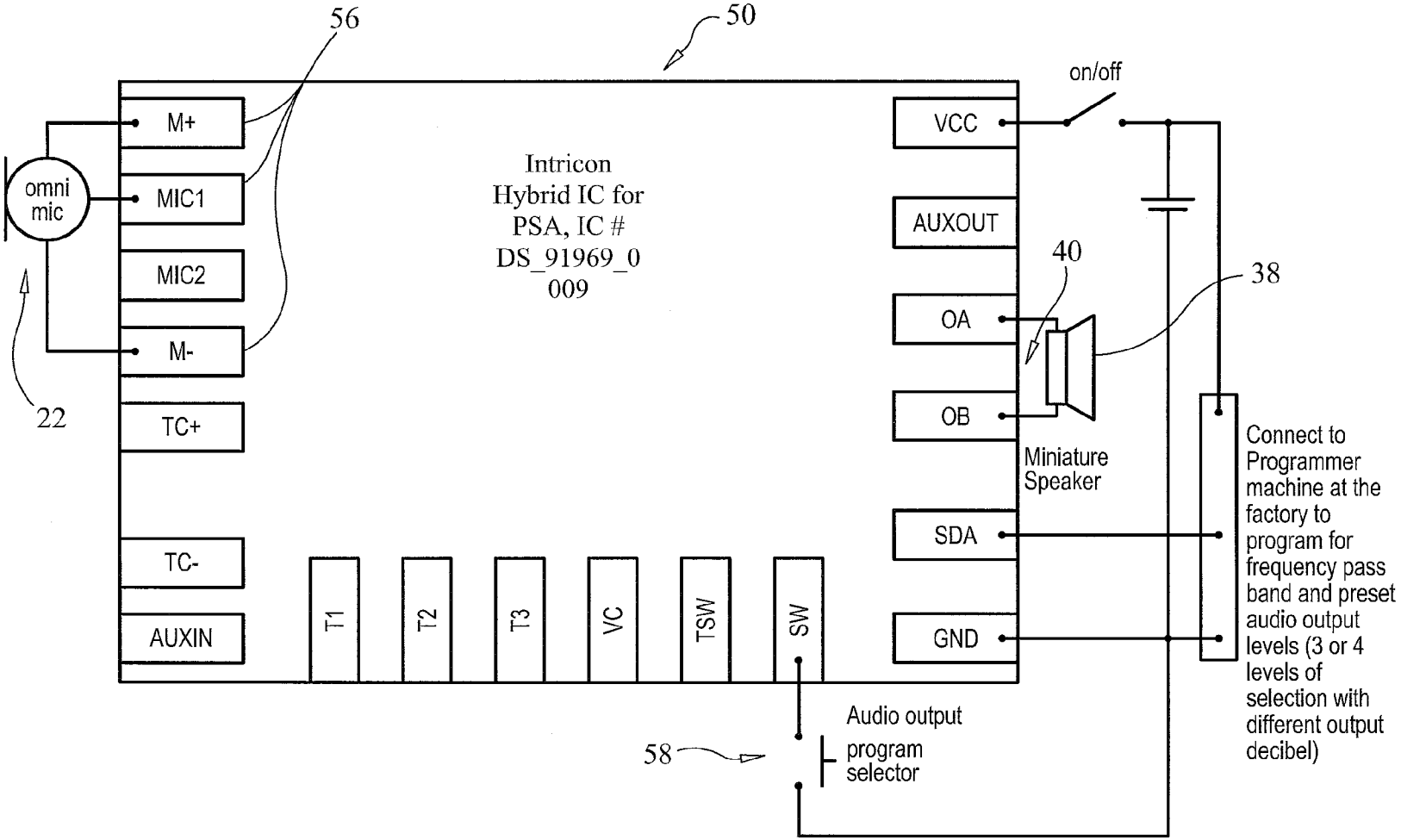
FIGS. 3A-3D (hereinafter collectively referred to as "FIG. 3") are sections of a schematic diagram of the electronic circuit of the personal sound amplifier formed in accordance with the present invention.
Figure 3B:
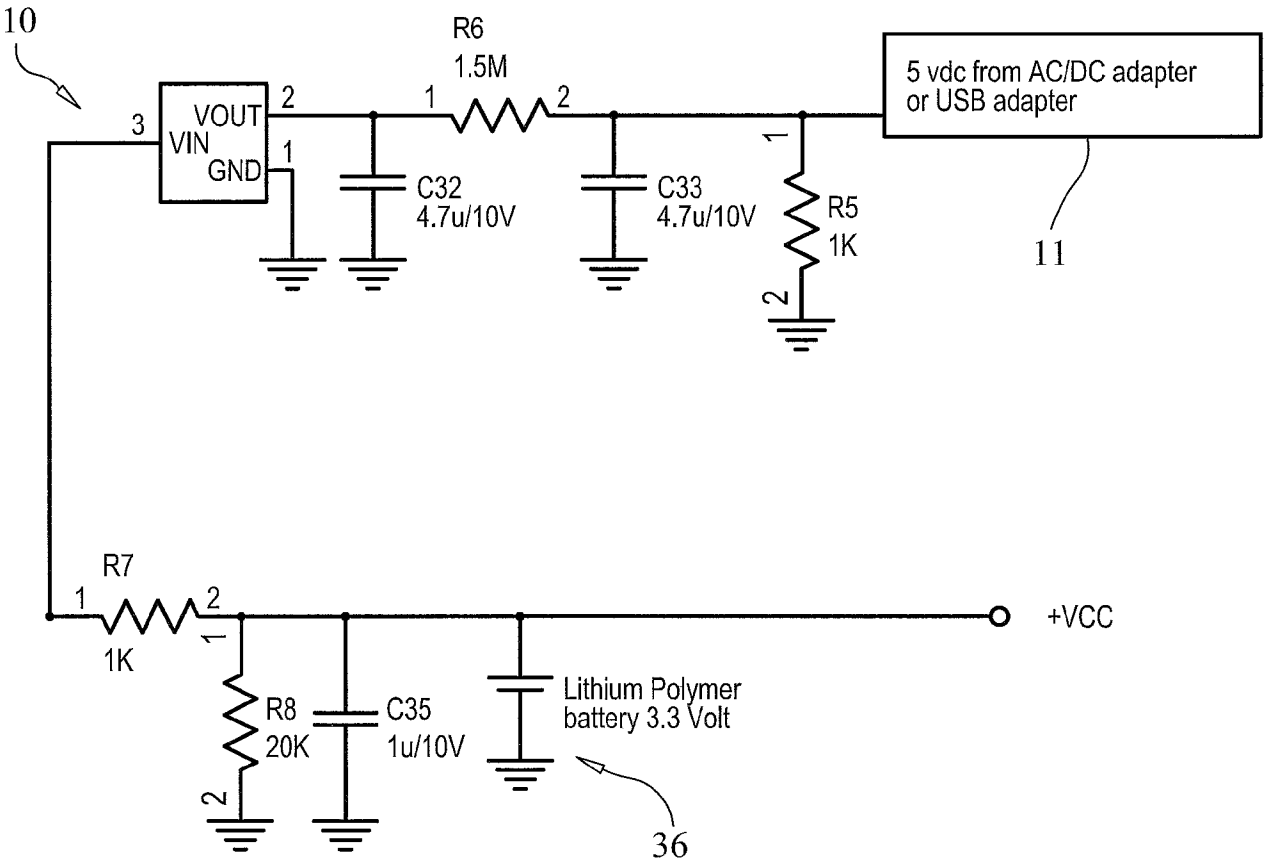
Figure 3C:
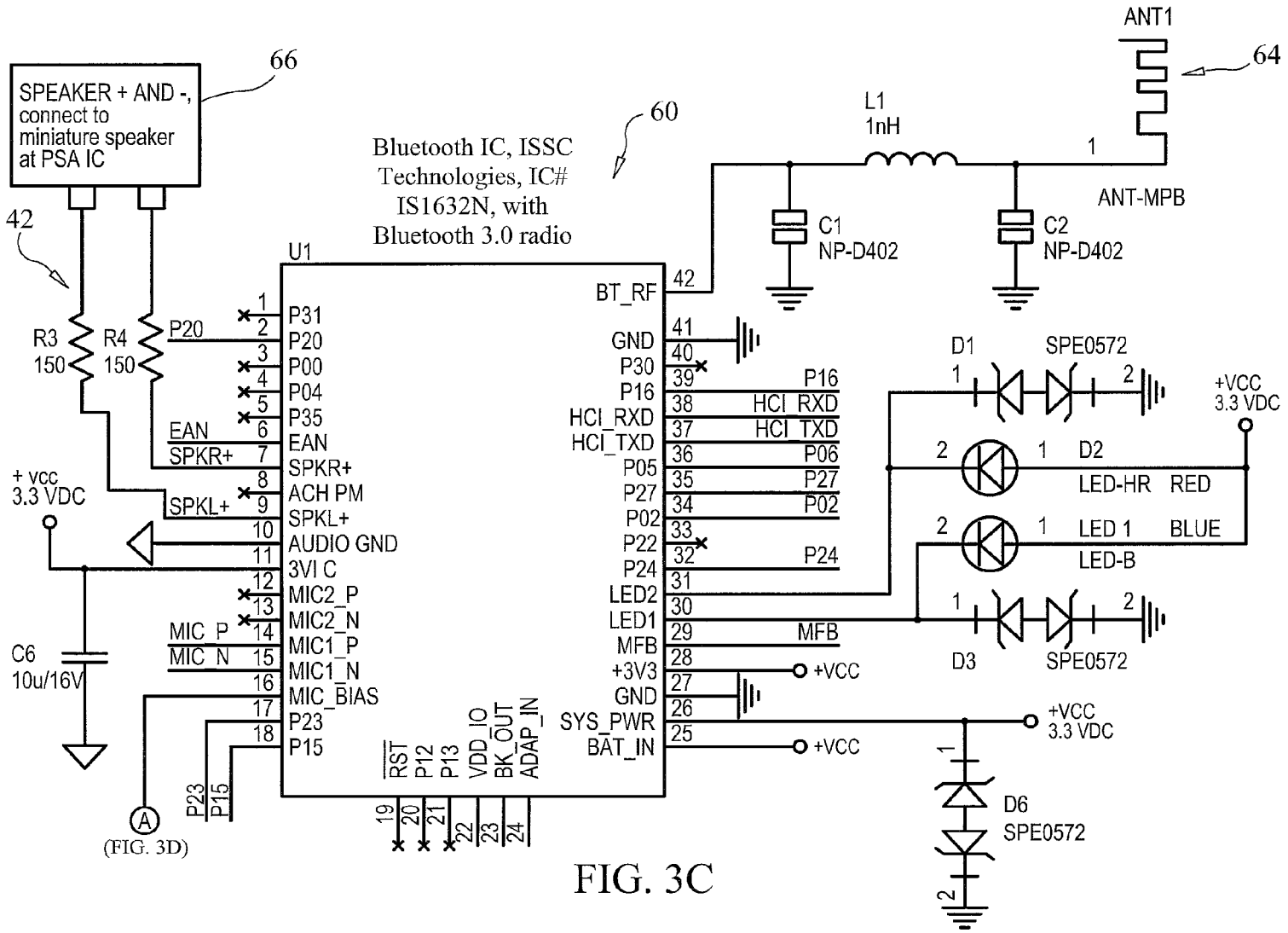
Figure 3D:
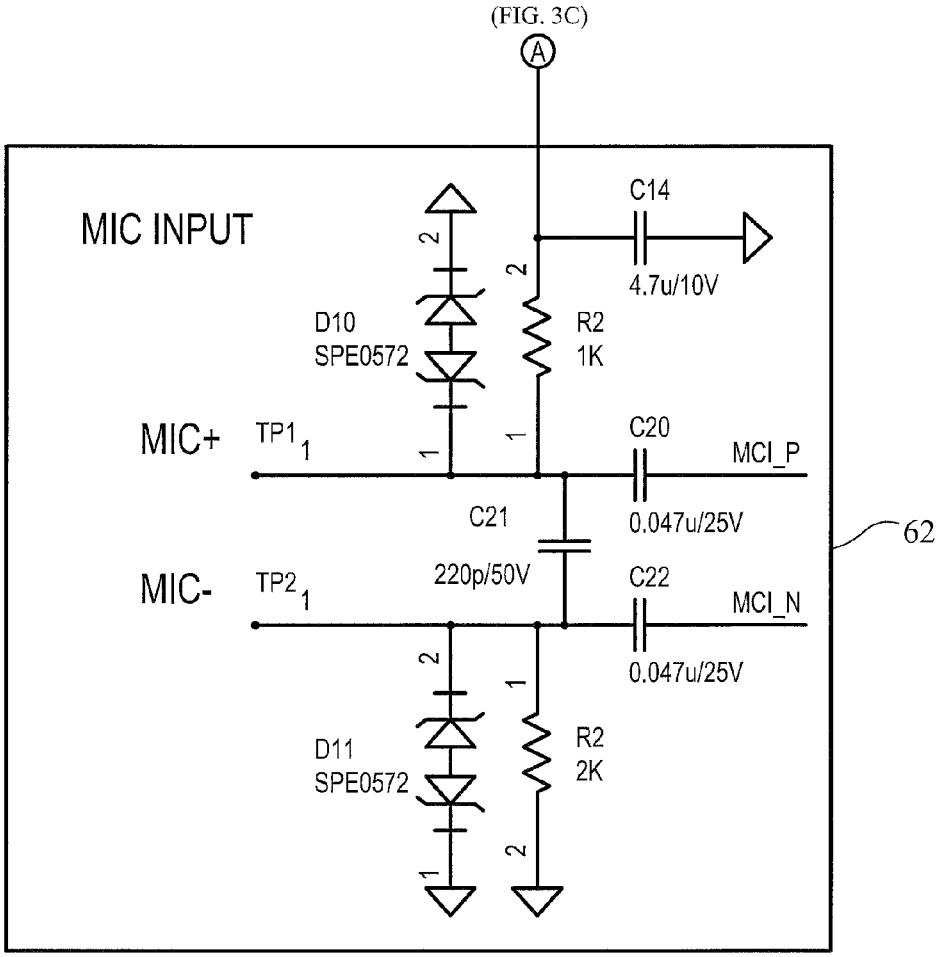

As can be seen in FIG. 1 of the drawings, a personal sound amplifier 2 constructed in accordance with a preferred embodiment of the present invention includes a main body or housing 4 formed in the shape of a hearing aid (i.e., with a generally arcuate shape) and ergonomically shaped to rest on the ear of a user. The housing or main body 4 is formed from two matable half sections. When mated together, the two sections define an internal cavity for housing the electronic circuit, antenna and battery of the personal sound amplifier 2. The main body 4 has mounted thereon a pair of microphones oriented at opposite lateral ends thereof, a mode selection switch 6, a Bluetooth™ circuit activator switch 8, a micro-USB connector 11 used in conjunction with a battery charging circuit for charging the internal battery, and a hollow hearing tube 12 extending from the main body 4. As will be described in greater detail, the electronic circuit situated in the internal cavity of the main body 4 includes a Bluetooth™ circuit 28 and a personal sound amplification circuit 30.

Figure 2:
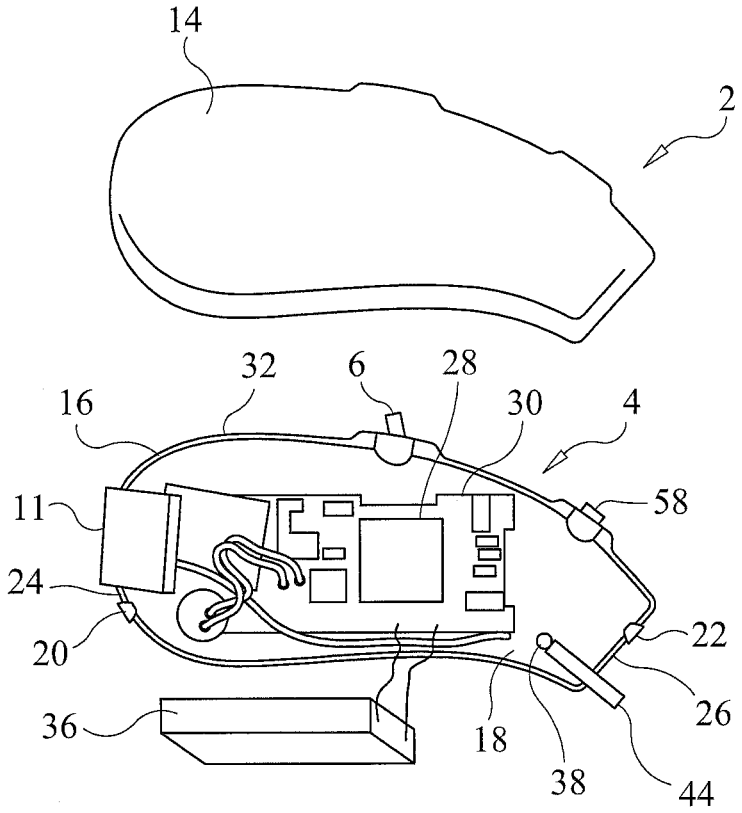
FIG. 2 is a partially exploded, perspective view of the personal sound amplifier formed in accordance with the present invention showing the internal circuitry contained within an internal cavity of the main body thereof.

More specifically, and referring to FIG. 2 of the drawings, it will be seen that the main body 4 comprises a first half section 14 and a second half section 16. When joined, the first half section 14 and the second half section 16 define an internal cavity 18 in which the circuitry and electronics of the personal sound amplifier 2 are secured. A first microphone 20 in electrical communication with the Bluetooth™ circuitry 28 extends at least partially through a first lateral end or side wall 24 of the main body 4. A second microphone 22 in electrical communication with the conventional personal sound amplification circuitry 30 extends at least partially through a second lateral end or side wall 26 of the main body 4, the second lateral end or side wall 26 being oriented opposite to the first lateral end or side wall 24. As will be described in greater detail, the first microphone 20 is utilized by the Bluetooth™ circuitry 28 to receive audible sounds from the user. The second microphone 22 is utilized by the conventional personal sound amplification circuitry 30 to receive ambient audible sounds and amplify them for the user. The microphones 20, 22 are positioned at opposite ends or side walls of the main body 4 to reduce feedback interference between the Bluetooth™ circuitry 28 and the conventional amplification circuitry 30.

Referring again to FIG. 1 of the drawings, it will be seen that a mode selection switch 6 in electrical communication with the Bluetooth™ circuitry 28 and conventional amplification circuitry 30 extends at least partially through a top portion 32 of the main body 4. The mode selection switch 6 allows the user to selectively control the operation of the personal sound amplifier device 2 of the present invention. When the mode selection switch 6 is in a first position, also referred to as the "up" position, the personal sound amplifier device 2 operates in a first mode in which the Bluetooth™ functionality and circuitry 28 are enabled and the conventional amplification (hearing aid) circuitry 30 is disabled. When the switch 6 is in a second position, also referred to as the "down" position, the device operates in a second mode in which both the Bluetooth™ functionality and circuitry 28 and the conventional amplification (hearing aid) circuitry 30 operate concurrently.

A Bluetooth™ circuit activator switch 8 in electrical communication with the Bluetooth™ circuitry 28 extends outwardly from the second half 16 of the main body 4. The activator switch 8 is preferably a momentary push button switch that controls the power to the Bluetooth™ circuitry 28 and the pairing of the Bluetooth™ circuitry 28 with an external Bluetooth™ capable device (not shown), as will be described in greater detail in the forthcoming paragraphs.

Referring to FIGS. 1 and 2 of the drawings, it will be seen that the battery charging circuit 10 includes a micro-USB female connector 11 which is mounted on the first lateral end 24 of the main body 4 and is provided to accept a male micro-USB connector 34 as a DC input. As will be described in greater detail, the female connector 11 is in electrical communication via internal circuitry with a lithium polymer battery 36 contained within the cavity 18 of the main body 4 that provides power to the Bluetooth™ circuitry 28 and conventional amplification circuitry 30 for the hearing aid function.

Referring to FIGS. 2 and 3 of the drawings, it will be seen that the conventional amplification circuitry's speaker output pins 40 and the Bluetooth™ circuitry's speaker output pins 42 are connected to a miniature internal speaker 38 positioned within the cavity 18. An outlet adapter 44, preferably being constructed of brass, is connected to the miniature speaker 38 and extends at least partially through the second end 26 of the main body 4. The hearing tube 12 further includes a first axial end 13. The first end 13 is fitted on the speaker outlet adapter 44. A dome or ear bud 48 is mounted on the length of the hollow hearing tube 12 and is placed in the ear canal of the user, and emits therefrom the sound carried by the hearing tube 12 from the speaker 38. The opposite end portion 15 of the tube 12 acts as a retention end and may be shaped to conform to the shape of the user's ear to help retain the ear bud or dome 48 within the ear canal.

Figure 4:
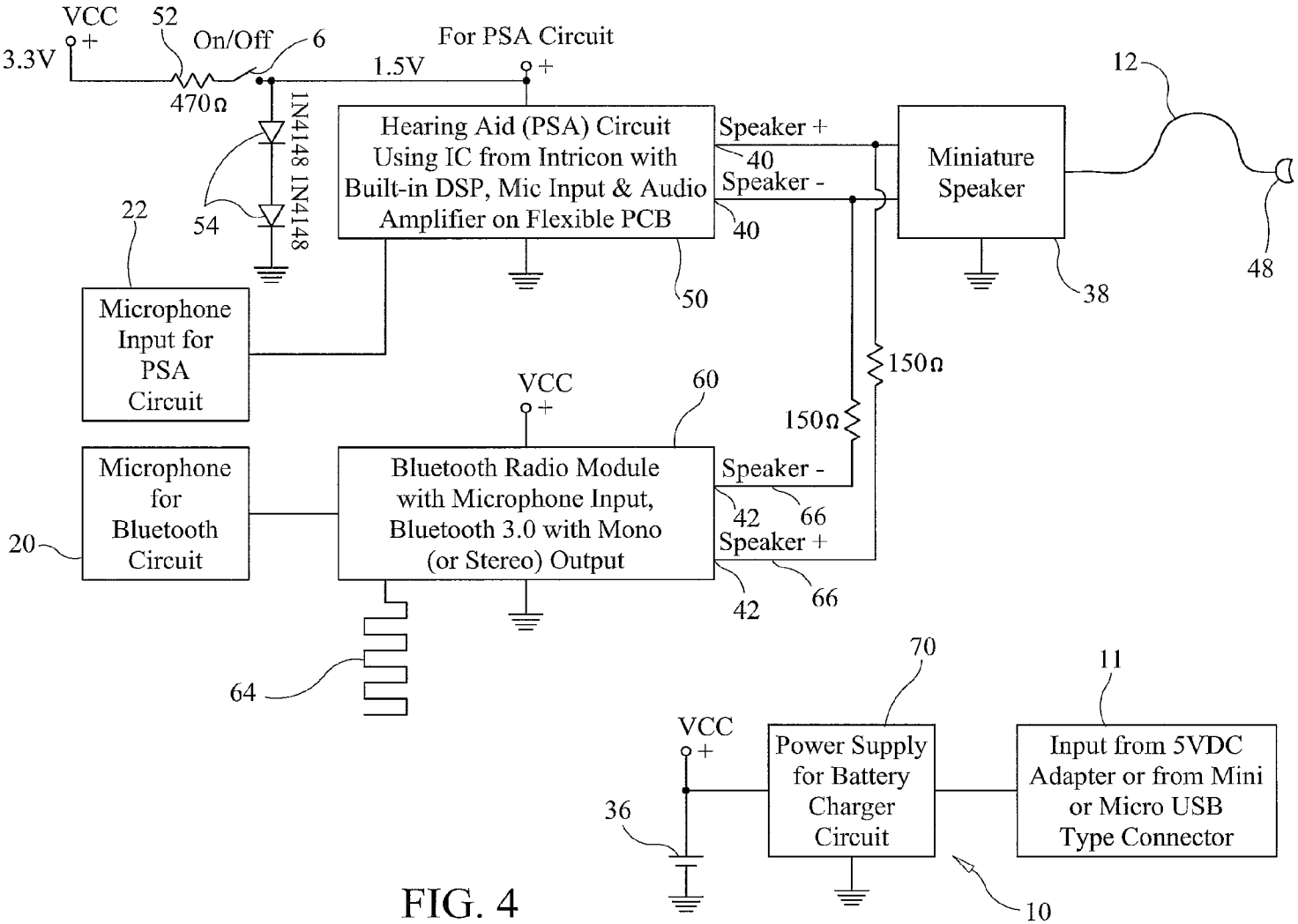
FIG. 4 is a block diagram of the electronic circuit of the personal sound amplifier formed in accordance with the present invention.

Again referring to FIG. 2 of the drawings, it is seen that the personal sound amplifier 2 formed in accordance with a preferred embodiment of the present invention includes conventional amplification circuitry 30 and Bluetooth™ circuitry 28 within the internal cavity 18 of the main body 4. Referring to FIGS. 3 and 4 of the drawings, it can be seen that the conventional amplification circuitry 30 preferably comprises an integrated circuit 50 manufactured by Intricon Corporation, specifically, the Intricon Hybrid IC for PSA, Part No. DS_91969_009, which includes integrated digital signal processing, a microphone input, and an audio amplifier on a flexible printed circuit board. The Intricon integrated circuit 50 is powered by a 3.3 volt (V) lithium polymer battery 36, which voltage is reduced from 3.3V to about 1.5V via a 470 ohm resistor 52 and two series-connected 1N4148 diodes 54. The mode selection switch 6 is connected in series between the lithium polymer battery 36 and the Intricon integrated circuit 50 so that, when the first mode (Bluetooth™ function only) is selected, the power to the Intricon integrated circuit 50 is cutoff and the conventional amplification circuitry 30 (for the hearing aid function) is disabled. When the second mode (both Bluetooth™ and hearing aid functions) is selected, the Intricon integrated circuit 50 is operational and receives audible sounds from the environment surrounding the user via the second microphone 22 connected to the microphone inputs 56 thereof. The received sounds are input to the integrated circuit's internal amplifier and output to the miniature speaker 38 contained within the housing cavity 18. The Intricon integrated circuit 50 may further be connected to an audio level adjustor 58, preferably in the form of a momentary push button switch, extending at least partially from the top portion 32 of the main body 4. The audio level adjustor 58, when activated, selectively adjusts the audio output decibel and frequency pass band of the integrated circuit 50 based upon three or four pre-programmed levels.

Again referring to FIGS. 3 and 4 of the drawings, it will be seen that the Bluetooth™ circuitry 28 within the cavity 18 of the main body 4 preferably includes a Bluetooth™ integrated circuit 60 manufactured by ISSC Technologies that comprises a Bluetooth 3.0 radio module with mono and/or stereo outputs, having Part No. IS1632N, mounted on a printed circuit board, and a microphone input 62. The Bluetooth™ integrated circuit 60 is powered by the lithium polymer battery 36. The Bluetooth™ circuit further includes a microstrip antenna 64 situated on the printed circuit board and oriented vertically (when the personal sound amplifier is properly worn by a user) for Bluetooth™ 2.4 GHz communication. The orientation and proximity of the microstrip antenna 64 to the user's body on the printed circuit board and within the main body 4 of the device 2 allows the user's body to enhance the microstrip antenna's reception/transmission and further reduces signal loss between the Bluetooth™ devices and the personal sound amplifier 2 so that the transmitting range can still meet the normal Bluetooth™ Class 2 radio standard of 30 feet. The first microphone 20 in electrical communication with the Bluetooth™ integrated circuit 60 receives the user's audible sounds. The audible sounds are then encoded by the integrated circuit's internal signal processor and are sent wirelessly to an external Bluetooth™-capable device, such as an iPhone™ device or Blackberry™ device, via the microstrip antenna 64. The microstrip antenna 64 also receives wireless transmissions from the external device and inputs them to the Bluetooth™ integrated circuit 60. The speaker outputs 66 of the Bluetooth™ integrated circuit 60 are connected to the internal miniature speaker 38. Transmissions received by the microstrip antenna 64 are processed by the integrated circuit 60 and then output to the user through the miniature speaker 38.

An LED (light emitting diode) Bluetooth™ status indicator 68 extending at least partially through the second half 16 of the main body 4, or at least visually identifiable within the second half 16 of the main body 4, is connected to the Bluetooth™ integrated circuit 60 and assists with the control of the device's Bluetooth™ functionality. More specifically, a user may selectively activate the Bluetooth™ function via activator switch 8 extending through the second half 16 of the main body 4 in response to the LED Bluetooth™ status indicator's output. For example, to establish communication between the external Bluetooth™-capable device and the personal sound amplifier 2 formed in accordance with the present invention, it is necessary to "pair" the devices. To pair the devices, it is first necessary to turn the Bluetooth™ function on by pressing the Bluetooth™ activator switch 8 once. Once the Bluetooth™ function has been turned on, the LED Bluetooth™ status indicator 68 will flash every two seconds to indicate that the Bluetooth™ functionality has been activated. To pair the personal sound amplifier 2 and the external Bluetooth™-capable device for the first time, the activator switch 8 is depressed for a few seconds and the LED indicator 68 will flash and then change to a steady illumination state, indicating that the personal sound amplifier's Bluetooth™ functionality is ready for pairing (i.e., the personal sound amplifier 2 may be recognized by the external Bluetooth™-capable device). The external device then searches for the Bluetooth™ signal transmitted by the personal sound amplifier 2, and a numeric pairing key corresponding to the Bluetooth™ integrated circuit, typically "0000", is entered to pair the devices. After the first pairing has been completed, the external device will recognize the personal sound amplifier for subsequent pairings automatically. To turn off the Bluetooth™ functionality, a user may press and hold the Bluetooth activator switch 8 for a few seconds, and the LED status indicator 68 will go off, indicating that the Bluetooth™ functionality has been turned off.

Referring again to FIGS. 3 and 4 of the drawings, it will be seen that the battery charging circuit 10 preferably includes a micro-USB female connector 11 (or some other form of adapter) in which a 5V DC source is input to a power supply or voltage regulator or converter circuit 70 defining at least a portion of the battery charging circuit 10. As shown in greater detail in the schematic illustrated in FIG. 3 of the drawings, the charging circuit 10 charges a 3.3V lithium polymer battery 36 that is positioned within the cavity 18 of the main body 4 of the personal sound amplifier 2 and provides power to both the Bluetooth™ circuitry 28 and the conventional amplifier circuitry 30 for the hearing aid function.

In operation, when the user desires to use the personal sound amplifier's Bluetooth™ functionality to communicate with his external Bluetooth™-capable cellular phone or other device, the user would place the mode selection switch 6 in the first position. In this position, the conventional amplifier circuitry 30 is disabled and the Bluetooth™ circuitry 28 is enabled. The user's audible transmissions are received by the first microphone 20 in electrical communication with the Bluetooth™ integrated circuit 60 and wirelessly transmitted to the paired external cellular phone. Incoming telecommunication transmissions received by the external cellular phone from a telecommunications network are then wirelessly transmitted back to the personal sound amplifier's Bluetooth™ integrated circuit 60 and output to the user from the miniature speaker 38 and hearing tube 12 connected thereto.

When the user desires to have both Bluetooth™ functionality and conventional amplifier functionality operating, for example, while driving a car in which it is necessary both to hear the ambient sounds of the road and communicate with an external cellular phone, the user may place the mode selection switch 6 in the second position. In this position, the lithium polymer battery 36 provides power to both the Bluetooth™ circuitry 28 and the conventional amplification circuitry 30. As discussed in the previous paragraph, the first microphone 20 will receive audible transmissions from the user and transmit them to the external cellular phone via the personal sound amplifier's Bluetooth™ integrated circuit 60. Simultaneously, the second microphone 22 in electrical communication with the conventional amplification circuitry 30 will receive ambient sounds from the environment, amplify them via the Intricon integrated circuit 50, and output them to the user through the miniature speaker 38 and hearing tube 12 connected thereto. As can be seen in the block diagram illustrated in FIG. 4 of the drawings, both the Bluetooth™ integrated circuit 60 and Intricon integrated circuit 50 output their signals to the same miniature speaker 38. Thus, the user may hear both amplified ambient sounds and wireless transmissions from an external device simultaneously from a single speaker 38. Furthermore, by using two separate microphones 20, 22 which are located on the main body 4 in opposite directions from each other, this arrangement reduces or avoids feedback interference from the ambient sounds detected by microphone 22 of the hearing aid circuit and the user's voice detected by the microphone 20 of the Bluetooth™ circuit. Accordingly, the user may be able talk on the phone via Bluetooth™ transmission and also be alert to surrounding ambient noise.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A personal sound amplifier device for amplifying sound and for communicating wirelessly with an external electronic device, which comprises:

a housing, the housing defining an internal cavity and having a first side wall and a second side wall situated opposite the first side wall, each of the oppositely situated first and second side walls forming a portion of the same housing;

a first microphone mounted on the housing and situated on the first side wall thereof, the first microphone detecting ambient sounds and generating an output signal in response thereto;

an amplification circuit situated in the internal cavity of the housing, the amplification circuit being responsive to the output signal of the first microphone and generating an amplified output signal in response thereto;

a speaker, the speaker being responsive to the amplified output signal of the amplification circuit and generating an audible sound in response thereto;

a second microphone, the second microphone being mounted on the housing, the second microphone detecting voice sounds emitted by a user of the personal sound amplifier device and generating an output signal in response thereto;

a radio frequency (RF) transmitter and receiver circuit, the RF transmitter and receiver circuit being situated in the internal cavity of the housing, the RF transmitter and receiver circuit being responsive to the output signal of the second microphone and generating a transmit signal in response thereto;

an antenna, the antenna being electrically coupled to the RF transmitter and receiver circuit, the antenna transmitting an RF signal to an external electronic device in response to the transmit signal of the RF transmitter and receiver circuit, the antenna receiving an RF signal transmitted by the external electronic device and generating a received signal in response thereto, the RF transmitter and receiver circuit generating a speaker signal in response to the received signal of the antenna, the speaker being responsive to the speaker signal of the RF transmitter and receiver circuit and generating an audible sound in response thereto; and one or more switches, the one or more switches being mounted on the housing and being accessible by a user of the personal sound amplifier device, the one or more switches being changeable to allow the user to selectively control the operation of the personal sound amplifier device, to allow the user to disable the RF transmitter and receiver circuit while enabling the amplification circuit, and to allow the user to enable both the RF transmitter and receiver circuit and the amplification circuit;

wherein the second microphone is situated on the second side wall of the housing opposite the first side wall to reduce feedback interference between the RF transmitter and receiver circuit and the amplification circuit; and wherein the personal sound amplifier device is in the form of a hearing aid, and the housing thereof has a generally arcuate shape in order to rest on the ear of a user of the personal sound amplifier device.

2. A personal sound amplifier device as defined by claim 1, which further comprises:

a speaker outlet adapter, the speaker outlet adapter being situated on the housing in proximity to the speaker; and a hearing tube, the hearing tube being coupleable to the speaker outlet adapter.

3. A personal sound amplifier device as defined by claim 1, wherein the amplification circuit includes an integrated circuit having a digital signal processor, a first microphone input and an audio amplifier.

4. A personal sound amplifier device as defined by claim 1, which further comprises:

an audio level adjustor, the audio level adjustor being mounted on the housing and being electrically coupled to the amplification circuit, the audio level adjustor selectively adjusting at least one of the gain of the amplification circuit and the frequency pass band of the amplification circuit.

5. A personal sound amplifier device as defined by claim 1, wherein the antenna is in the form of a microstrip antenna.

6. A personal sound amplifier device as defined by claim 1, which further comprises:

an indicator, the indicator being mounted on the housing so as to be viewable by a user of the personal sound amplifier device, the indicator being electrically coupled to the RF transmitter and receiver circuit, the indicator indicating to the user at least one of whether the RF transmitter and receiver circuit is disabled and whether the RF transmitter and receiver circuit is enabled.

7. A personal sound amplifier device as defined by claim 1, which further comprises:

an RF transmitter and receiver circuit activator switch, the RF transmitter and receiver circuit activator switch being electrically coupled to the RF transmitter and receiver circuit, the RF transmitter and receiver circuit activator switch being mounted on the housing so as to be accessible to a user of the personal sound amplifier device, the RF transmitter and receiver circuit activator switch being selectively changeable by the user to at least a first state, wherein the RF transmitter and receiver circuit activator switch disables the RF transmitter and receiver circuit, and a second state, wherein the RF transmitter and receiver circuit activator switch enables the RF transmitter and receiver circuit.

* * * * *